US007107902B1

(12) United States Patent
Scholzig et al.

(10) Patent No.: US 7,107,902 B1
(45) Date of Patent: Sep. 19, 2006

(54) SHEET-GUIDING DEVICE FOR A PRINTING MACHINE

(75) Inventors: Jurgen Scholzig, Mainz-Finthen (DE); Ulrich Jung, Limburg (DE); Ruth Kremer, Steinbach (DE); Thomas Walther, Freigericht (DE)

(73) Assignee: Man Roland Druckmaschinen AG, Offenbach am Main (DE)

( * ) Notice: Subject to any disclaimer, the term of this patent is extended or adjusted under 35 U.S.C. 154(b) by 501 days.

(21) Appl. No.: 10/031,157

(22) PCT Filed: Jul. 4, 2000

(86) PCT No.: PCT/EP00/06212

§ 371 (c)(1),
(2), (4) Date: Apr. 1, 2002

(87) PCT Pub. No.: WO01/05593

PCT Pub. Date: Jan. 25, 2001

(30) Foreign Application Priority Data

Jul. 16, 1999 (DE) ..... 199 33 438

(51) Int. Cl.
*B41F 9/00* (2006.01)

(52) U.S. Cl. ..... 101/218; 101/137; 101/140; 101/145; 101/247

(58) Field of Classification Search ..... 101/136, 101/137, 140, 141, 143, 145, 481.1, 218, 101/247, 115, 116, 118, 127; 118/107, 109, 118/110, 111, 114, 115, 117, 119, 46, 212, 118/218; 427/211, 428
See application file for complete search history.

(56) References Cited

U.S. PATENT DOCUMENTS 3,677,178 A * 7/1972 Gipe ..... 101/450.1

(Continued)

FOREIGN PATENT DOCUMENTS

| | | | |
|---|---|---|---|
| DE | 39 31 479 | A1 | 4/1991 |
| DE | 43 22 791 | A1 | 1/1995 |
| DE | 196 41 031 | A1 | 6/1997 |
| DE | 197 19 624 | C1 | 6/1998 |
| DE | 197 52 492 | A1 | 6/1999 |
| EP | 0 306682 | A2 | 3/1989 |
| EP | 0 480 230 | A1 | 4/1992 |
| FR | 2 587 274 | A3 | 3/1987 |
| GB | 2 267 095 | B | 11/1993 |

*Primary Examiner*—Andrew H. Hirshfeld
*Assistant Examiner*—Kevin D. Williams
(74) *Attorney, Agent, or Firm*—Leydig, Voit & Mayer, Ltd.

(57) ABSTRACT

The invention relates to a sheet-guiding device in a printing machine. The object of the invention is to provide such a sheet-guiding device which in a printing/varnishing unit that is not involved in the printing/varnishing process, permits the smear-free passage of the printing material in a printing/varnishing nip. This is achieved in that on the blanket/plate cylinder 12, 2 there is arranged a printing plate with an ink/varnish-repellent surface coating, it being possible for the blanket/plate cylinder 12, 2 to be driven at the machine speed, and the sheet-carrying cylinder 1 conveying the printed or varnished printing material.

17 Claims, 2 Drawing Sheets

U.S. PATENT DOCUMENTS 3,718,115 A * 2/1973 Lee ..... 118/203
3,762,322 A * 10/1973 Vines ..... 101/228
4,327,641 A * 5/1982 Goodwin et al. ..... 101/144
5,053,311 A * 10/1991 Makino et al. ..... 430/166
5,176,077 A 1/1993 DeMoore et al.
5,178,064 A 1/1993 Kerber et al.
5,488,902 A 2/1996 Dorenkamp
5,676,053 A * 10/1997 Schafer ..... 101/141
5,881,643 A 3/1999 Silvestre
5,979,322 A * 11/1999 DeMoore et al. ..... 101/401.1
6,136,375 A * 10/2000 Bressler et al. ..... 427/277
6,244,178 B1 * 6/2001 DeMoore et al. ..... 101/401.1
6,289,812 B1 * 9/2001 Adams et al. ..... 101/491
6,374,730 B1 * 4/2002 Kuratani et al. ..... 101/115
6,640,702 B1 * 11/2003 Watanabe et al. ..... 101/115

* cited by examiner

SHEET-GUIDING DEVICE FOR A PRINTING MACHINE

FIELD OF THE INVENTION

The invention relates to a sheet-guiding device for a printing machine and more particularly, to a sheet-guiding device adopted for assisting sheet control in the area of a printing or varnishing nip.

BACKGROUND OF THE INVENTION

A conventional sheet-guiding device is disclosed, for example, by EP 0 306 682 A2. The device essentially comprises two blow strips to which blown air is applied and which are arranged upstream and downstream of the press nip formed between a blanket cylinder and a printing cylinder, over the cylinder width and parallel to the axis. The blow strip which is upstream in the conveying direction is arranged in a space above the incoming sheet between the blanket cylinder and printing cylinder. The blown-air stream is directed onto the blanket cylinder, into the printing zone itself and onto the upper side of the sheet carried in the grip of the grippers on the printing cylinder. The downstream blow strip, arranged downstream of the printing zone in the conveying direction, produces a blown-air stream which is directed onto the upper side of the sheet carried on the printing cylinder and onto the blanket cylinder, counter to the conveying direction. The reference primarily describes the sheet-guiding device during printing operation (print on position). Furthermore, in printing practice it is usual for the blown-air operation to be maintained when the blanket cylinder is thrown off (print off position), for example when checking the paper run or when a printing unit is not involved in the printing. The sheet printing material is then conveyed through the means of blown air (without contact with the inactive blanket cylinder).

According to DE 197 19 624 C1, a sheet-guiding device in a printing machine is known for guiding printing materials in the area of the blanket/plate cylinder and sheet-carrying cylinder when the blanket/plate cylinder is inactive. In this case, the blanket/plate cylinder, in the print off position, can be-positioned and fixed in position with a cylinder channel assigned adjacent to the circumferential surface of the sheet-carrying cylinder, it being possible for the blanket/plate cylinder to be stopped on the drive side by means of a clutch. Provided in the cylinder channels are sheet guide elements, which ensure the guidance of the sheet by mechanical and/or pneumatic means.

In the case of these pneumatically operated sheet-guiding devices, a disadvantage is that given the relatively high elasticity of the printing materials, such as for example in the case of board or sheet metal, the effectiveness of the sheet guidance is reduced. As a result of the relative movement with the blanket/plate cylinder stationary and the printing material being conveyed, the risk of smearing is increased, and as a result the print quality can be impaired.

UK patent GB 2 267 095 B discloses a varnishing device for a printing machine which is arranged downstream of the last printing unit. In the case of a varnishing unit which is not involved in the printing operation or not involved in the varnishing operation (the varnishing system is shut down), the contact between a freshly printed upper side of the printing material on the plate cylinder as it passes through the press nip can be prevented. For this purpose, the varnishing unit is constructed in two parts as a lower part and an upper part. The lower part accommodates the back-pressure cylinder and the upper part accommodates the plate cylinder with the varnish metering system. When the varnishing operation is shut down (print off position), the upper part, mounted in rotary joints on the lower part, is pivoted away from the sheet-carrying printing cylinder. This means that a relatively large distance between plate cylinder and printing cylinder can be achieved in the press nip (varnishing zone), and the sheet can pass through the varnishing unit without smearing without the use of pneumatic sheet-guiding means. If the varnishing operation is to be carried out again, the upper part is brought into contact with the lower part, and thus the plate cylinder is brought into contact again with the sheet-carrying printing cylinder (print on position). For this purpose, the previously uncoupled drive is re-engaged.

OBJECT AND SUMMARY OF THE INVENTION

It is an object of the invention to provide a sheet-guiding device in a printing machine which permits the uniform guidance of a printing material on a sheet-carrying cylinder, preferably a printing cylinder, in a printing/varnishing unit that is not involved in the printing/varnishing process, and ensures smear-free passage of the sheet printing material through a printing/varnishing nip formed by a blanket/plate cylinder and sheet-carrying cylinder.

In the case of in-line sheet-fed rotary printing machines with printing units for multi-colour printing, one or, more varnishing units can be assigned to the printing units for in-line finishing. In this case, a varnishing unit can be compared with an offset printing unit, in that the blanket cylinder of the printing unit then corresponds, as is known, to the plate cylinder of the varnishing unit, which is functionally connected to an applicator roll and a varnish metering system. Here, a in the varnishing unit.

It has been found, inter alia, that in the case of an inactive printing/varnishing unit that is not involved in the printing or varnishing process, the sheet printing material to be conveyed through the press nip can be influenced in terms of its guidance directly in the press nip or varnishing nip.

According to the invention, a plate or film, for example a printing plate or printing film, fixed on the blanket/plate cylinder is constructed with an ink/varnish-repellent surface coating.

The plate or film is preferably constructed with a layer of silicone rubber. A plate or film of this type is, in particular, a printing plate or printing film, which can be employed as a relief printing plate or as a planographic printing plate with an ink/varnish-repellent coating. In this case, the relief printing plate can be constructed with layers of silicone rubber over the entire area or distributed zone by zone over the width, preferably being arranged in the conveying direction of the sheet printing material.

Alternatively, a planographic printing plate for damping-solution-free offset printing, also called waterless offset printing or dry planographic printing, can be employed. A planographic printing plate of this type has, inter alia, a layer of silicone rubber and a light-sensitive photopolymer layer. In the case of preferred UV exposure under a positive, the layer of photopolymer experiences hardening and, in so doing, bonds with the layer of silicone rubber. The layer of silicone rubber hardened in this way on the printing plate repels ink or varnish. In a preferred embodiment, this planographic printing plate for damping-solution-free offset printing is constructed with a layer of silicone rubber over the entire area. Alternatively, layers of silicone rubber are arranged distributed zone by zone over the width of this planographic printing plate, preferably in the conveying direction of the sheet printing material.

In a further embodiment, a plate is constructed as a printing film and fixed on the plate cylinder which, as the upper layer, has a layer of silicone rubber over the entire area, the associated substrate being at least a carrier plate, for example an aluminum plate, or a rubber blanket.

In a further embodiment, a plate or film constructed with an ink/varnish-repellent coating with a very smooth surface or surface layer is fixed on the blanket cylinder or plate cylinder. A coating of this type preferably has a surface roughness of approximately 1 to 10 μm.

In this case, a first surface or surface layer consists of chromium or aluminum or contains at least a proportion thereof.

In a further embodiment, a surface or surface layer consists of organic/inorganic hybrid polymers, which is arranged on a substrate consisting of aluminum or at least containing aluminum.

In a further embodiment, inlays of a fluoropolymer or fluoropolymers can also be realized in the composite, for example in cracks, gaps or pores, in the abovementioned surface or surface layer of chromium or aluminum, including anodized aluminum.

If a plate/film is constructed with a chromium surface or a surface at least containing chromium, such a plate/film can also be implemented as a surface polished to a mirror finish.

A blanket/plate cylinder which can be rotatably driven at machine speed and has a plate or film, for example a printing plate or printing film, with an ink/varnish-repellent coating, in a printing/varnishing unit that is not involved in the printing/varnishing process, can be moved into a print off position or a position with a gentle printing pressure in relation to the printing material—taking into account the thickness of the printing material. A sheet printing material fixed in the grip of grippers can then be conveyed through a printing/varnishing nip by means of a sheet-carrying cylinder with the already printed and/or varnished side facing the blanket/plate cylinder.

In this case, it is advantageous that, in order to implement the sheet guidance, the blanket/plate cylinder with plate or film and ink/varnish-repellent coating can be rotatably operated. In such case, noticeably low frictional torques occur between the printed and/or varnished printing material transported on a rotating sheet-carrying cylinder, in particular printing cylinder, and an associated, rotating blanket/plate cylinder (with plate or film with ink/varnish-repellent coating) as the relative rotating movements are carried out, by which means the risk of smearing is reduced.

Moreover, it is advantageous that the splitting of ink/varnish can be reduced considerably by means of the ink/varnish-repellent coating of the plate or film fixed on the blanket/place cylinder so that any impairment to the print quality can additionally be avoided.

A further advantage is based on the fact that a drive with a clutch for positioning the cylinder channel in relation to the printing cylinder and stopping the blanket/plate cylinder is superfluous.

It is likewise advantageous that the sheet-guiding device can be employed irrespective of the modulus of elasticity of the sheet printing materials to be processed.

Blow pipes which can be operated pneumatically and are arranged upstream and downstream of the printing/varnishing nip, and sheet guide elements arranged in the cylinder channel are not required.

In order to provide additional assistance to the sheet guidance, blowing devices can be arranged upstream and downstream of the printing/varnishing nip and assist the transport of the printing materials on the sheet-carrying cylinder.

DETAILED DESCRIPTION OF THE PREFERRED EMBODIMENTS

Referring now more particularly to the drawings, there is shown an illustrative in-line sheet-fed rotary printing machine. In this case, a number of printing units for multicoloured printing, with sheet-carrying cylinders 1, for example printing cylinders, are lined up with one another and are connected to one another by transfer cylinders 17 or turning systems.

Figure 1:
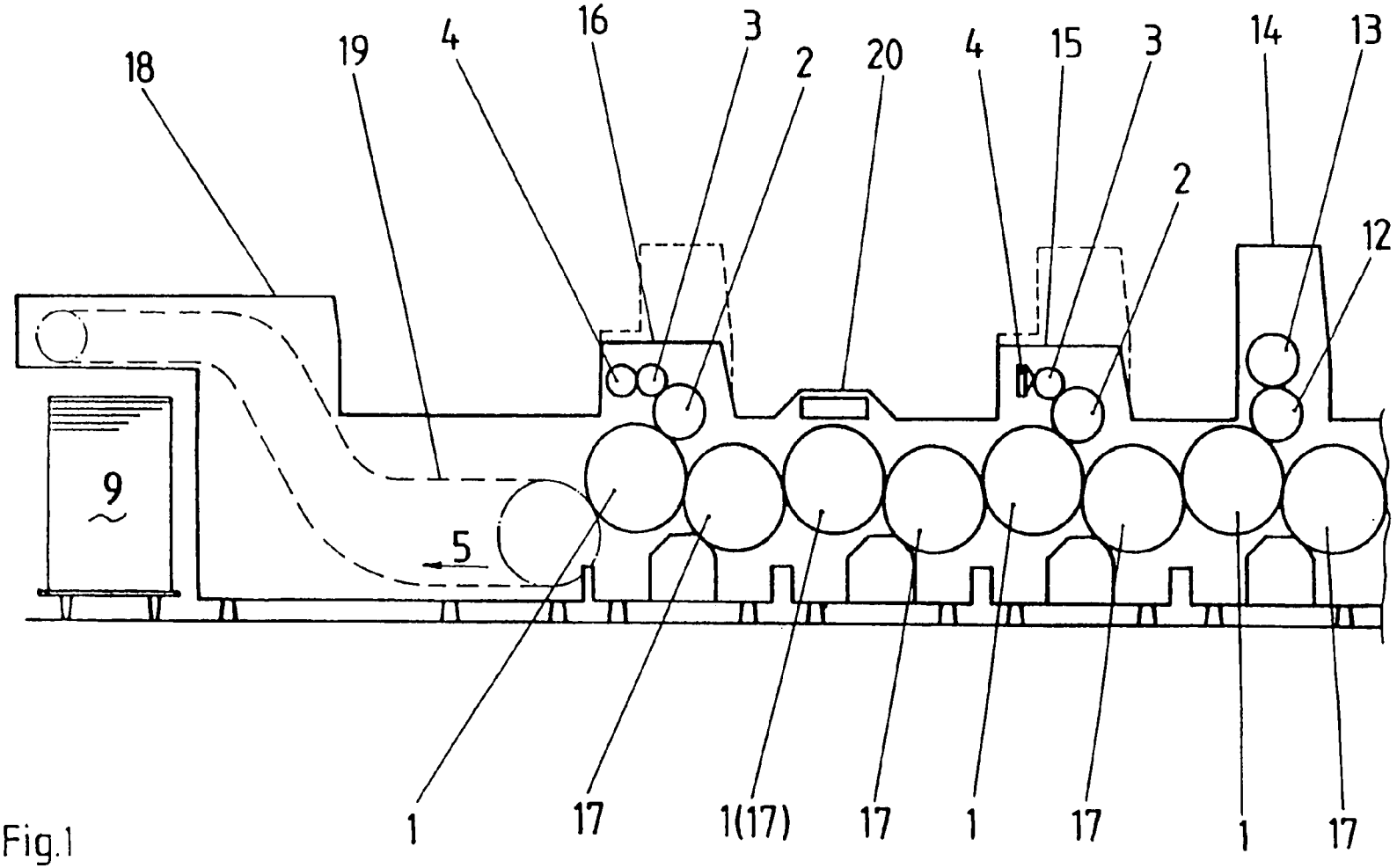
FIG. 1 is a partially schematic side elevational view of a sheet fed rotary printing machine having sheet-guide devices in accordance with the invention.

FIG. 1 shows a partial view of such a printing machine for in-line finishing. Shown here is only a last printing unit 14 having a plate cylinder 13, a blanket cylinder 12 and a printing cylinder 1 as sheet-carrying cylinder. Assigned to the plate cylinder 13 is an inking unit and, if appropriate, a damping unit, which need not be discussed in detail here.

Arranged downstream of the printing unit 14, in the conveying direction 5, is a first varnishing unit 15, which is formed by a plate cylinder 2, an applicator roll 3 and a metering system 4, for example a metering roll (two-roll unit) or a chamber-type doctor or at least a dip roll operating on the dip-roll principle. In this case, the metering system 4 can be employed optionally. The plate cylinder 2 is in turn assigned to the printing cylinder 1. Arranged downstream of the first varnishing unit 15 is a dryer device 20, for example an infrared (1R) dryer, assigned to an adjacent printing cylinder 1 or an adjacent transfer cylinder 17. In the conveying direction 5, the dryer device 20 is followed by a second varnishing unit 16 with plate cylinder 2, applicator roll 3 and metering system 4 which can be optionally employed. The printing cylinders 1 and printing units 14, varnishing units 15, 16 and the dryer device 20 are connected to one another for sheet transport by means of transfer cylinders 17. The printing cylinders 1 and the transfer cylinders 17 are of double-size construction in relation to a single-size blanket cylinder 12 and a single-size plate cylinder 2 and have gripper systems 7, 8 arranged symmetrically on the periphery.

In conveying direction 5, the second varnishing unit 16 is followed by a deliverer 18, which feeds the sheet printing material in a known way, by means of circulating chain systems 19, to a deliverer stack 9 and deposits it there.

Figure 2:
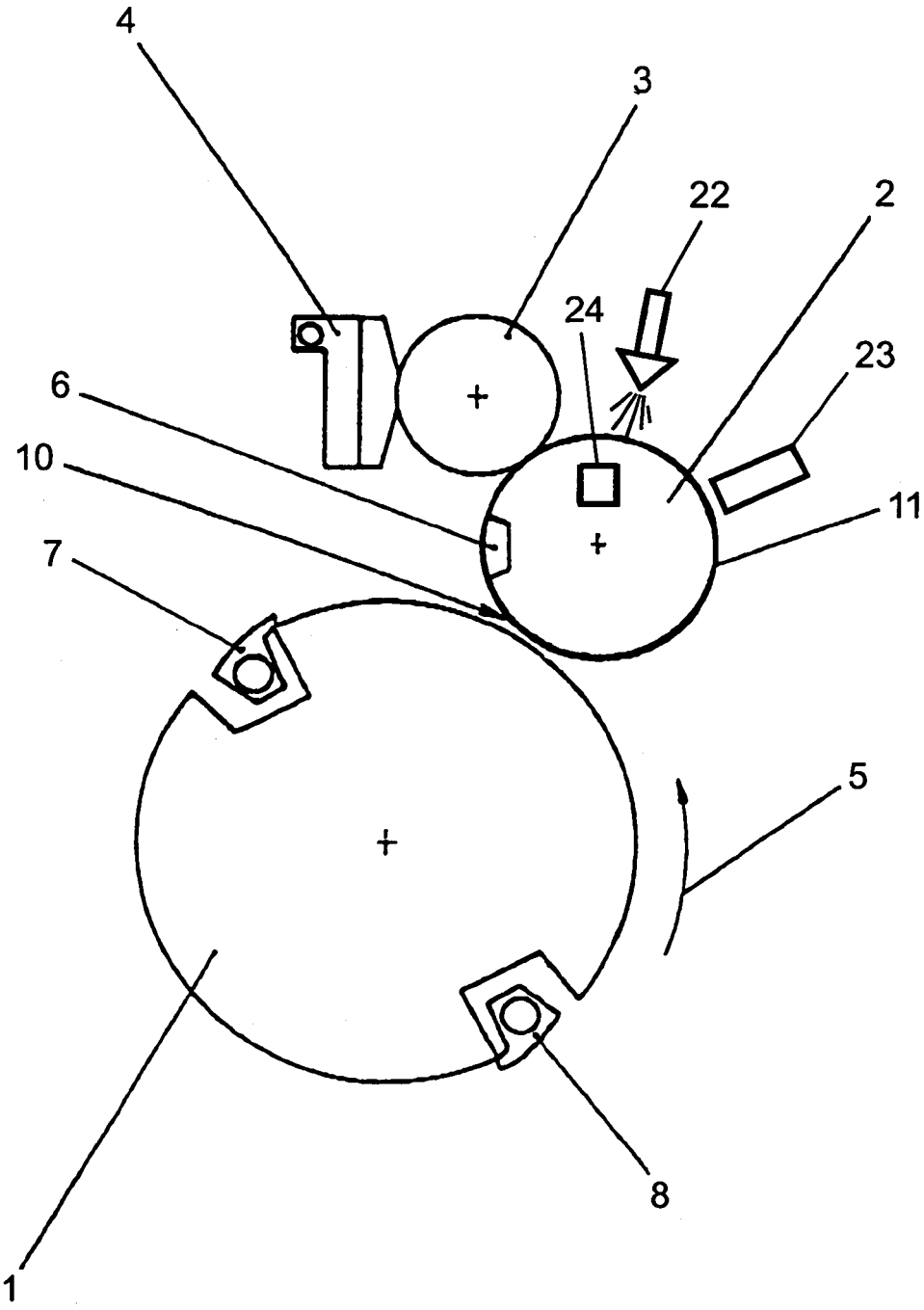
FIG. 2 is an enlarged schematic of one of the sheet-guide devices in accordance with the invention.

The second varnishing unit 16, as depicted in FIG. 2, is shown inactive, that is to say it is not involved in the varnishing process. In this case, the metering system 4 is formed by a chamber-type doctor with an associated engraved applicator roll 3. A plate 11 in this case is fixed on the plate cylinder 2 of the varnishing unit 16, the said plate cylinder 2 having a cylinder channel 6. Alternatively, a printing film 11 could be used. The plate/film or printing plate/printing film 11 is provided with an ink/varnish-repellent surface, preferably a coating, and can preferably be fixed to the cylinder in the area of the cylinder channel 6. In one embodiment, the plate/film 11 is a printing plate/printing film with a layer of silicone rubber on the surface. For instance, on the plate cylinder 2 there may be provided, as plate/film 11, a planographic printing plate for damping-solution-free offset printing, with an ink/varnish-repellent layer of silicone rubber formed over the entire area. Alternatively, the plate/film 11 is constructed as relief printing plate.

The plate cylinder 2 can be moved by appropriate known means into a print off position, so that a clearance in the printing nip or varnishing nip 10 is formed between the printing cylinder 1 and plate cylinder 2. An already previously printed sheet is led in the grip of grippers of the rotating printing cylinder 1 through the printing/varnishing nip 10 of the varnishing unit 16 that is not involved in the printing/varnishing process. At the same time, the plate cylinder 2 located in the print off position, together with the printing plate 11 or printing film 11, rotates in the conveying direction 5 at the machine speed, and the printing material is transported through the printing/varnishing nip 10 without smearing.

In a u operating mode, the plate cylinder 2—taking into account the thickness of the printing material—can be set to a position with a gentle printing pressure in relation to the printing material. In this case there is only a defined, slight frictional contact between the printing plate 11 on the plate cylinder 2 and the printing material fixed on the printing cylinder 1. The already previously printed and/or varnished sheet is led in the grip of grippers of the rotating printing cylinder 1 through the printing/varnishing nip 10 of the varnishing unit 16 that is not involved in the varnishing process. At the same time, the plate cylinder 2 located in the position of gentle printing pressure (with the printing plate/printing film 11) rotates in the conveying direction 5 at the machine speed, and the printing material is led through the printing/varnishing nip 10 without smearing but in contact with the printing plate/printing film 11.

In still a further embodiment, a plate or film 11 with an ink/varnish-repellent surface or surface layer can be brought into contact with a release agent. The release agent can be transferred—with the varnish supply interrupted—via the metering system 4, for example a chamber-type doctor with a feed and return line, and the applicator roll 3 to the plate or film 11 on the rotating plate cylinder 2. The release agent preferably contains at least silicone and/or water.

In a further embodiment, the plate cylinder 2 is assigned an additional device, with which the release agent can be transferred to the plate or film 11 with ink/varnish-repellent coating fixed on the plate cylinder 2. Suitable for this purpose, for example, is a spray device 22 that extends in the axial direction over the width of the plate cylinder 2 and whose spray nozzles are directed towards the plate cylinder 2, so that the release agent can be transferred to the plate/film 11.

The use of a release agent prevents any possible splitting back of the ink or varnish from the printed/varnished printing material onto the plate or film. In addition, the release agent counteracts any possible contamination of the plate/film as a result of the splitting-back of ink/varnish. Therefore, cleaning operations which are otherwise necessary can be reduced.

In a further embodiment, the plate or film 11 fixed on the plate cylinder 2 and having an ink/varnish-repellent surface can have its temperature controlled. In one embodiment, a temperature control device 23 supplying cold air is provided adjacent to the plate/film 11. The cold air is directed onto the plate/film 11 and forms a film of moisture, which acts as release agent, as condensation on the plate/film 11. In a further embodiment, the plate cylinder 2 (or blanket cylinder 12) carrying the plate/film 11 can have its temperature controlled by a temperature control device 24 within the cylinder circumference.

The position of the plate cylinder 2, and alternatively of the blanket cylinder 12, with a defined printing pressure in relation to the printing material, or the print off position of blanket/plate cylinder, is not restricted to one of the embodiments of plate or film 11.

If the plate cylinder 2 is to be involved in the varnishing process again, the printing plate/printing film 11 with varnish/ink-repellent surface coating is exchanged, for example for a rubber blanket or a flexographic printing plate, the varnish supply is activated and the plate cylinder 2 is then moved into the print on position.

It will be appreciated that the invention is not restricted to a plate cylinder 2 or comparable blanket cylinder 12. Instead, the respective cylinder 2, 12 can be substituted by a roll with an ink/varnish-repellent surface that is not involved in the printing/varnishing process. The roll is then assigned to the sheet-carrying cylinder 1.

What is claimed is:

1. A printing machine comprising:

a plurality of active printing units for applying a liquid medium to a side of printing material at the operating speed of the machine; said active printing units each having a first cylinder and an associated sheet carrying cylinder; said sheet carrying cylinder of each active printing unit having grippers for engaging and transferring printing material through a nip defined between the first cylinder and the associated sheet carrying cylinder whereby a liquid medium can be applied to the printing material;

at least one inactive printing unit having a first cylinder and an associated sheet carrying cylinder; said sheet carrying cylinder of each said inactive printing unit having grippers for engaging and transferring a sheet though a nip defined between the first cylinder and the associated sheet carrying cylinder of the inactive printing unit; said first cylinder of each inactive printing unit being moveable relative to the associated sheet carrying cylinder to a print-off position such that the printing unit is inactive during a printing operation and not involved in applying a liquid medium to a side the printing material during operation of the printing machine; and said first cylinder of each said inactive printing unit having a liquid repellant surface and being rotatable at the operating speed of the printing machine with the associated sheet carrying cylinder conveying printing material through the nip between the sheet carrying cylinder and the first cylinder with a printed side of the printing material facing the liquid repellant surface of the first cylinder for enabling passage of the printing material through the nip without smearing of liquid medium previously applied to the printing material in said active printing units.

2. The printing machine of claim 1 in which said first cylinder of each said inactive printing unit is a blanket cylinder having an ink repellant surface.

3. The printing machine of claim 1 in which said first cylinder of each said inactive printing unit has a silicon rubber layer on the surface thereof.

4. The printing machine of claim 1 in which said first cylinder of each inactive printing unit is a plate cylinder having an ink repellent surface.

5. The printing machine of claim 1 in which said first cylinder of each said inactive printing unit has a film on the surface thereof.

6. The printing machine of claim 1 in which said first cylinder of each inactive printing unit has a planographic printing plate thereon operable for use in dampening-solution-free offset printing.

7. The printing machine of claim 1 in which said first cylinder of each inactive printing unit has a relief surfaced printing plate thereon.

8. The printing machine of claim 1 in which said first cylinder of each inactive printing unit is positionable in relation to the sheet-carrying cylinder with a predetermined pressure.

9. The printing machine of claim 1 in which said first cylinder of each inactive printing unit has a surface is defined by a composition that contains at least one of chromium, aluminum, or anodized aluminum.

10. The printing machine of claim 1 in which said first cylinder of each inactive printing unit has an outer surface defined by an organic or inorganic hybrid polymer on an aluminum substrate.

11. The printing machine of claim 9 in which said first cylinder of each inactive printing unit has an outer surface with discontinuities such as cracks, gaps or pores which are filled with inlays of at least one fluoropolymer.

12. The printing machine of claim 1 in which said first cylinder of each inactive printing unit has an outer printing surface that is polished to a mirror finish.

13. The printing machine of claim 1 in which each inactive printing unit has a metering system and applicator roll for selectively applying a release agent to said first cylinder.

14. The printing machine of claim 1 in which said first cylinder of each inactive printing unit has a spray device extending the axial length of said first cylinder for selectively directing a release agent onto a surface of the first cylinder.

15. The printing machine of claim 1 in which said first cylinder of each inactive printing unit has a device for controlling the temperature of the surface of the first cylinder thereof.

16. The printing machine of claim 1 in which said first cylinder of each inactive printing unit has a cold air temperature control device for controlling the temperature of the surface of the first cylinder thereof.

17. The printing machine of claim 16 in which said temperature control device is operable within the first cylinder of the inactive printing unit.

* * * * *